United States Patent [19]

Jakonczuk

[11] Patent Number: 4,815,389

[45] Date of Patent: Mar. 28, 1989

[54] SHOT CARTRIDGE

[75] Inventor: Joseph W. Jakonczuk, Cabot, Ark.

[73] Assignee: Remington Arms Company, Wilmington, Del.

[21] Appl. No.: 80,474

[22] Filed: Jul. 31, 1987

[51] Int. Cl.[4] ..... F42B 7/08

[52] U.S. Cl. ..... 102/453; 102/448; 102/462; 102/532

[58] Field of Search ..... 102/448, 449, 450, 451, 102/452, 453, 462, 463, 532

[56] References Cited

U.S. PATENT DOCUMENTS

| | | | |
|---|---|---|---|
| 38,414 | 5/1863 | Root | 102/463 |
| 1,557,696 | 10/1925 | Holden | 102/449 |
| 2,591,286 | 4/1952 | Paulve | 102/462 |
| 2,840,944 | 7/1958 | Thompson | 102/448 |
| 2,842,057 | 7/1958 | Dunn | 102/449 |
| 2,894,456 | 7/1959 | Olin | 102/463 |
| 3,205,819 | 9/1965 | Barrick | 102/462 |
| 4,048,899 | 4/1977 | Bachhuber | 86/39 |

*Primary Examiner*—Donald P. Walsh

[57] ABSTRACT

A shot cartridge suitable for use in automatic and semi-automatic pistols, characterized by a metal case terminated in a hemispherical crimp and a wad that expands to fill the barrel diameter of a pistol.

9 Claims, 1 Drawing Sheet

SHOT CARTRIDGE

BACKGROUND OF THE INVENTION

Effort has previously been directed toward the development of a shot cartridge that could be used in pistols, and particularly automatic and semi-automatic weapons. However, difficulties which have been encountered have included the ability to satisfactorily retain the shot in the cartridge and to operate in automatic or semi-automatic pistols.

SUMMARY OF THE INVENTION

The present invention provides an improved shot cartridge which is useful in revolvers as well as automatic and semi-automatic pistols.

Specifically, the instant invention provides, in a cartridge for use in a pistol having a metal case with a shoulder and a neck at the forward end of the case, a powder charge and a shot charge, the improvement wherein the neck is closed in a substantially uniform, segmental, hemispherical crimp, the crimp terminating in an aperture having a diameter smaller than that of the shot; and a wad between the powder charge and the shot.

Preferably, the wad has a circular web with a diameter about from 0.001 to 0.015 inch less than the inside diameter of the neck of the shell and integral resilient skirts around the perimeter of the web which, in their unstressed configuration, extend outward from the edge of the web about from 0.010 to 0.065 inch greater than the diameter of the web and which are compressible to the diameter of the web.

DETAILED DESCRIPTION OF THE INVENTION

Figure 1:
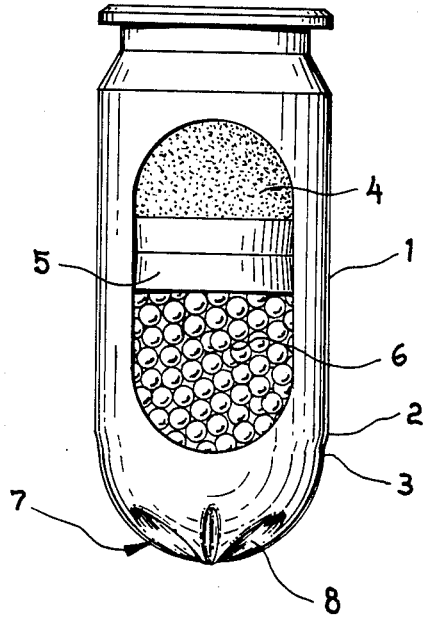
FIG. 1 is a side view of a cartridge of the present invention, partly cut away to show the elements of the cartridge.

The present invention is applicable to the preparation of shot cartridges for all conventional sizes of pistol and revolver ammunition, including, for example, 25, 32, 38, and 45 caliber and 9 mm Luger cartridges. The cartridges comprise the case, powder charge and primer appropriate to such cartridges, and a bullet. However, the cartridges of the present invention further comprise a shot charge instead of a bullet, and a wad to separate the shot from the powder.

A central feature of the present invention is the provision of a substantially uniform, segmental, hemispherical crimp to close the case. The cases used in the present cartridges are prepared from any suitable metal, such as aluminum or brass, and typically have a shoulder and a neck at the forward end of the case. The crimp is generally formed from 4 to 8 segments. It is convenient to form the crimp from an even number of segments, and a crimp formed from 6 segments is particularly preferred for manufacturing convenience. The closing crimp can be started with a conventional star crimping tool, and finished with a die that forms the crimp to the required substantially hemispherical configuration.

The crimp should terminate in an aperture having a diameter of less than the diameter of the shot used in the charge, to insure that the shot will be properly contained. In general, the aperture should be at least about 0.005, and preferably at least about 0.010 inch smaller than the diameter of the shot. For example, for #12 shot, having a diameter of 0.050 inch, an aperture of no greater than about 0.045 inch should be used.

The shot used in the present cartridges will vary with the size of the cartridge as well as the intended use. In general, 9, 10, and #12 shot has been found to be well suited to the present cartridges, and #12 shot has been found to be particularly satisfactory for .45 caliber cartridges.

A wad is needed to provide a gas seal, and preferably comprises a circular web with skirts around the perimeter. The wad can be prepared from those materials commonly used for wads, and particularly thermoplastic materials such as polyethylene, polyamides and the like. An important consideration for the wad material is a resiliency that permits the skirts on the wad to adjust to the difference between the diameters of the cartridge casing and the barrel of the gun.

The diameter of the circular web of the preferred wads should be about from 0.001 to 0.015 inch less than the inside diameter of the neck of the shell, to permit easy assembly of the cartridge components. Accordingly, for a 45 caliber cartridge, for example, the diameter of the web is typically about 0.410 inch. The thickness of the web will vary according to the material used and the size of the cartridge, but can, for example, be about 0.050 inch thick.

The skirts around the perimeter of the web are integral with the web and extend outward from the edge of the web, in their unstressed condition, by an amount sufficient to seal the wad against the wall of the gun barrel after discharge, generally about from 0.010 to 0.065 inch. The resilient nature of the material permits these skirts to be compressed inside of the cartridge casing to approximately the inner diameter of the casing. The skirts preferably extend to a diameter, in their unstressed condition, which is about from 0.030 to 0.050 inch greater than that of the web.

The invention will be more fully understood by reference to the drawings, in which FIG. 1 is a side view of a cartridge of the present invention, partly cut away to show the elements of the cartridge. There, casing 1, having shoulder 2 leading into neck 3 contains powder charge 4, wad 5 and shot charge 6. The neck is formed into a hemispherical crimp 7, made up of segments 8.

Figure 2:
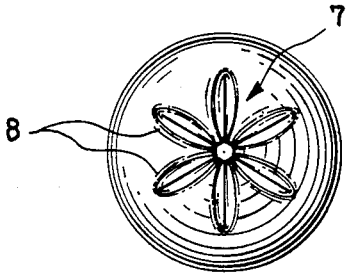
FIG. 2 is an end view of a cartridge of the present invention, showing the hemispherical crimp.

The hemispherical crimp is better shown in FIG. 2, which is an end view of a cartridge of the present invention.

Figure 3:
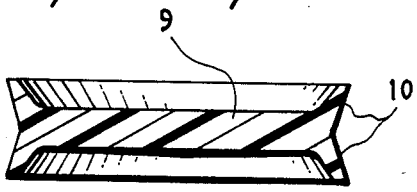
FIG. 3 is a cross-sectional view of a preferred wad of the present invention.

The preferred wad of the present invention is more fully shown in FIG. 3, which is a cross-sectional view of the wad. In that Figure, central web 9 is integral with skirts 10, which extend outward from the edge of the web. In their inwardly stressed configuration, these skirts can be compressed to a position substantially perpendicular to the web, and flush with the walls of the cartridge. Upon firing of the cartridge and leaving the casing, the skirts return to their unstressed configuration, mating with the walls of the barrel. Thus, an effective seal is maintained within the barrel to permit the shot charge to be propelled by the powder gases.

The shot cartridges of the present invention can be used in revolvers as well as automatic and semi-automatic pistols, due primarily to the hemispherical crimp which, being integral with the rest of the casing, does not interfere with the normal functioning of the cartridge in the pistol. The present cartridges are particularly well suited for the control of varmints and pests, as well as survival and self-defense applications.

The invention is further illustrated in the following specific example.

EXAMPLE

A .45 caliber ACP brass pistol cartridge having a lengthened and necked case was loaded with a large pistol primer, about 8–8.5 grains of powder, and a wad prepared from polyethylene. The wad had a web diameter of 0.410 inch and a web thickness of 0.050 inch. Integral skirts extended from the perimeter of the web, at an angle of 15°, 15′ to a diameter 0.025 inch larger than the diameter of the web, or 0.0125 inch in each direction extending from the perimeter of the web.

A charge of 120 grains of #12 shot was loaded after the wad, and the neck was closed with a 6-segmented crimp, leaving an aperture having a diameter of 0.040 inch. The crimp was formed by starting with a star crimp tool to form a Venko style crimp, and finishing the crimp with a crimping die. The final substantially hemispherical crimp had a radius of 0.224 inch, and was suitable for feeding in automatic and semi-automatic pistols.

I claim:

1. In a cartridge for use in a pistol having a metal case with a shoulder and a neck at the forward end of the case, a powder charge and a shot charge, the improvement wherein the neck is closed in a substantially uniform, segmental, hemispherical crimp, the crimp terminating in an aperture having a diameter smaller than that of the shot; and a wad between the powder charge and the shot.

2. A cartridge of claim 1 wherein the hemispherical crimp is formed from 4 to 8 segments.

3. A cartridge of claim 2 wherein the hemispherical crimp is formed from an even number of segments.

4. A cartridge of claim 3 wherein the hemispherical crimp is formed from 6 segments.

5. A cartridge of claim 1 wherein the wad has a circular web with a diameter about from 0.001 to 0.015 inch less than the inside diameter of the neck of the shell and integral resilient skirts around the perimeter of the web which, in their unstressed configuration, extend outward from the edge of the web to a diameter about from 0.010 to 0.065 inch greater than the diameter of the web and which are compressible to substantially the diameter of the web.

6. A cartridge of claim 5 wherein the web has a diameter of about from 0.005 to 0.010 inch less than the inside diameter of the neck of the shell.

7. A cartridge of claim 6 wherein the skirts around the perimeter of the web, in their unstressed configuration, extend outward from the edge of the web to a diameter about from 0.030 to 0.050 inch greater than the diameter of the web.

8. A cartridge of claim 5 wherein the wad consists essentially of thermoplastic polymer.

9. A cartridge of claim 8 wherein the wad consists essentially of polyethylene.

* * * * *